US009228162B2

(12) United States Patent
Kim et al.

(10) Patent No.: US 9,228,162 B2
(45) Date of Patent: Jan. 5, 2016

(54) TRANSPARENCY SOLID CLEANING AGENT

(71) Applicant: DONG-A TEACHING MATERIALS CO., LTD., Daejeon (KR)

(72) Inventors: Hak Jae Kim, Daejeon (KR); Han Shin Jung, Daejeon (KR)

(73) Assignee: DONG-A TEACHING MATERIALS CO., LTD., Daejeon (KR)

( * ) Notice: Subject to any disclaimer, the term of this patent is extended or adjusted under 35 U.S.C. 154(b) by 14 days.

(21) Appl. No.: 14/069,668

(22) Filed: Nov. 1, 2013

(65) Prior Publication Data

US 2014/0135249 A1 May 15, 2014

(30) Foreign Application Priority Data

Nov. 9, 2012 (KR) ..... 10-2012-0126875

(51) Int. Cl.

| | |
|---|---|
| ***C11D 17/00*** | (2006.01) |
| ***C11D 3/18*** | (2006.01) |
| ***C11D 3/20*** | (2006.01) |
| ***C11D 3/22*** | (2006.01) |
| ***C11D 3/30*** | (2006.01) |
| ***C11D 10/04*** | (2006.01) |
| *C11D 1/14* | (2006.01) |
| *C11D 1/29* | (2006.01) |

(52) U.S. Cl.

CPC ..... *C11D 17/0095* (2013.01); *C11D 3/188* (2013.01); *C11D 3/2041* (2013.01); *C11D 3/2065* (2013.01); *C11D 3/221* (2013.01); *C11D 3/222* (2013.01); *C11D 3/30* (2013.01); *C11D 10/042* (2013.01); *C11D 1/146* (2013.01); *C11D 1/29* (2013.01)

(58) Field of Classification Search

None

See application file for complete search history.

(56) References Cited

U.S. PATENT DOCUMENTS

| | | | | |
|---|---|---|---|---|
| 6,147,040 | A | 11/2000 | van der Hagen | |
| 2010/0069277 | A1 * | 3/2010 | McFann et al. ..... | 510/152 |

FOREIGN PATENT DOCUMENTS

| | | |
|---|---|---|
| EP | 2476734 | 7/2012 |
| JP | 11-293231 | 10/1999 |
| JP | 2003-105394 | 4/2003 |
| KR | 10-2001-0011187 | 2/2001 |
| KR | 10-2011-0100184 | 9/2011 |
| WO | 96/04360 | 2/1996 |
| WO | 2011/104886 | 9/2011 |

OTHER PUBLICATIONS

European Patent Office, European Search Report for EP13191923, Mar. 12, 2014, Munich, Germany.

* cited by examiner

*Primary Examiner* — Necholus Ogden, Jr.
(74) *Attorney, Agent, or Firm* — Lex IP Meister, PLLC

(57) ABSTRACT

The present invention relates to a transparent solid cleaning agent that is convenient to carry because it has solid pen shape, and has no concern of contents flowing because it is a solid. According to one aspect of the invention, a transparent solid cleaning agent comprising 10 to 70 wt % of gel forming material including alkali metal salt or ammonium salt of C8-36 aliphatic carboxylic acid, 2 to 30 wt % of a transparency agent, 2 to 30 wt % of a subsidiary transparency agent, 0.1 to 10 wt % of orange oil, and 0.5 to 20 wt % of anionic surfactant is provided. The transparent solid cleaning agent according to the present invention is convenient to carry because it has a solid pen shape, has no concern of contents flowing because it is a solid, prevents collapse or bending, and has an excellent sense of beauty because the contents are transparent.

7 Claims, 1 Drawing Sheet

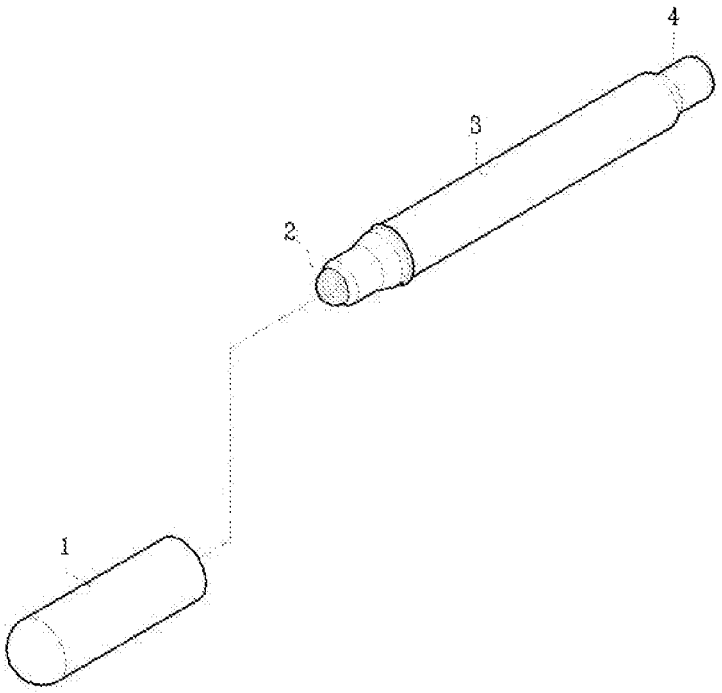
4
3
2
1

TRANSPARENCY SOLID CLEANING AGENT

BACKGROUND OF THE INVENTION (a) Field of the Invention

The present invention relates to a transparent solid cleaning agent, more particularly to a transparent solid cleaning agent that is convenient to carry because it has a solid pen shape, and has no concern of contents flowing because it is a solid.

(b) Description of the Related Art

In everyday life, if foreign substance splashes on clothes, and the like to generate stain, removal of stain using wet towel or tissue would cause stain to be deeply penetrated into the clothes and remain as it is. In this case, the appearance is not good, and important activities may be hindered. And, if stain is not immediately removed and left, removal of stain may become more difficult.

To solve these problems, a cleaning agent that is sprayed or coated on the polluted parts of clothes, and the like is commercially available. However, these cleaning agents are inconvenient to carry because they are liquid types, or when they are sprayed or coated on the polluted parts, carelessness may cause liquid flowing outside of the container.

SUMMARY OF THE INVENTION

It is an object of the present invention to provide a transparent solid cleaning agent that is convenient to carry because it has a solid pen shape, has no concern of contents flowing because it is a solid, prevents collapse or bending, and has transparent contents.

According to one aspect of the invention, the transparent solid cleaning agent comprises 10 to 70 wt % of gel forming material including alkali metal salt or ammonium salt of C8-36 aliphatic carboxylic acid, 2 to 30 wt % of a transparency agent, 2 to 30 wt % of an subsidiary transparency agent, 0.1 to 10 wt % of orange oil, and 0.5 to 20 wt % of anionic surfactant.

The anionic surfactant may have an average HLB value of 7 or more.

And, the anionic surfactant may be selected from the group consisting of sodium lauryl sulfate, sodium lauryl ether sulfate, sodium lauryl ether sulfate, ammonium lauryl sulfate, ammonium lauryl ether sulfate, triethanolamine lauryl sulfate, triethanolamine lauryl ether sulfate, and magnesium lauryl ether sulfate.

And, the transparency agent may be aliphatic amino alcohol.

And, the subsidiary transparency agent may be selected from the group consisting of polysaccharides, glycols and polyalcohols.

Meanwhile, the transparent solid cleaning agent may have a pen shape that is used while stored in a screw-type holder.

And, the transparent solid cleaning agent may be used for stain removal of clothes, and it may be used for pre-removal of stain when washing clothes.

The transparent solid cleaning agent according to the present invention has advantages in that it is convenient to carry because it has a solid pen shape, has no concern of contents flowing because it is a solid, prevents collapse or bending, and has an excellent sense of beauty because the contents are transparent.

BRIEF DESCRIPTION OF THE DRAWINGS

FIG. 1 is a perspective view showing the use example of the transparent solid cleaning agent according to the present invention.

DETAILED DESCRIPTION OF THE EMBODIMENTS

The present invention may have many examples and various modifications may be made, and specific examples will be illustrated in drawings and explained in detail. However, it should be understood that the present invention is not limited to specific examples, and includes all modifications, equivalents or substitutions within the scope and technical scope of the invention. In the explanations of the invention, detailed explanations of related known technologies may be omitted if it is judged to obscure the subject matter of the invention.

According to one aspect of the invention, a transparent solid cleaning agent comprising 10 to 70 wt % of gel forming material including alkali metal salt or ammonium salt of C8-36 aliphatic carboxylic acid, 2 to 30 wt % of a transparency agent, 2 to 30 wt % of an subsidiary transparency agent, 0.1 to 10 wt % of orange oil, and 0.5 to 20 wt % of anionic surfactant is provided.

The transparent solid cleaning agent according to the present invention has advantages in that it is convenient to carry because it has a solid pen shape, has no concern of contents flowing because it is a solid, prevents collapse or bending, and has an excellent sense of beauty because the contents are transparent.

Hereinafter, constructional elements of the transparent solid cleaning agent according to one aspect of the invention will be explained in detail.

The gel forming material that is used in an embodiment of the invention includes alkali metal salt or ammonium salt of C8-36 aliphatic carboxylic acid.

The aliphatic carboxylic acid is alkali metal salt or ammonium salt of linear or branched aliphatic carboxylic acid having 8 to 36 carbon atoms, and preferably, aliphatic carboxylic acid having 12 to 18 carbon atoms.

The aliphatic carboxylic acid constituting the aliphatic carboxylic acid salt may include, for example, caprylic acid, pelargonic acid, undecanoic acid, lauric acid, myristic acid, palmitic acid, stearic acid, arachic acid, behenic acid, lignoceric acid, cerotic acid, montanic acid, melissic acid, and the like.

In addition, examples of the alkali metal salt of the aliphatic carboxylic acid include lithium salts, sodium salts, potassium salts, and the like, and particularly, sodium myristate, sodium palmitate, sodium stearate, or mixtures thereof are preferable.

The mixing ratio of the aliphatic carboxylic acid salt may be preferably 10 to 70 wt %, more preferably 15 to 60 wt % in the total raw material composition when the transparent solid cleaning agent according to the present invention is manufactured.

If the amount of the aliphatic carboxylic acid salt is 10 wt % or more, the transparent solid cleaning agent may be easily made hard, and thus, it is advantageous in terms of gel formation, and the strength of the cleaning agent may be improved. Meanwhile, if the amount is 70 wt % or less, melting of the aliphatic carboxylic acid salt may be facilitated when heating and mixing, smooth application to a polluted part may be enabled, and fluidity may be improved thus facilitating shaping.

In the transparent solid cleaning agent according to the present invention, if an alkoxylated nitrogen-containing compound is added, the content may be made transparent.

Examples of the alkoxylated nitrogen-containing compounds that may be added may include aliphatic amino alcohol, alicyclic amino alcohol, aromatic amino alcohol, and the like, and among them, aliphatic amino alcohol is preferable, and compounds which are in a liquid state at room temperature are preferable.

As the aliphatic amino alcohol, compounds represented by the formulas R12NR2OH, R1N(R3OH)2, N(R4OH)3, and the like may be illustrated, and when a plurality of R1 are present in one compound at an alkyl group having 1 to 6 hydrogen atoms or 1 to 6 carbon atoms, they may be identical or different from each other. R2OH, R3OH and R4OH are respectively an alkoxyl group having 1 to 5 carbon atoms or a group represented by —R5OR6OH (wherein, R5 and R6 are respectively an alkylene group, and the total number of carbon atoms of R5 and R6 is 2 to 10), and when the number thereof is plural in one compound, they may be identical or different from each other.

Examples of the aliphatic amino alcohol may include ethanolamine, diethanolamine, triethanolamine, dimethylethanolamine, isopropanolamine, diisopropanolamine, triisopropanolamine, isobutanolamine, N,N-diethylethanolamine, N,N-dibutylethanolamine, N-methyl-N,N-diethanolamine, dimethylisopropanolamine, methylethanolamine, aminoethylethanolamine, ethyldiethanolamine and N,N-diisopropylethanolamine, and a combination thereof, and particularly, ethanolamine, diethanolamine, triethanolamine, dimethylethanolamine, isopropanolamine, triisopropanolamine, and isobutanolamine are preferable.

The use amount of the alkoxylated nitrogen-containing compound may be preferably 2 to 30 wt %, more preferably 5 to 20 wt %, particularly preferably, 3 to 15 wt % in the total raw material composition of the transparent solid cleaning agent according to the present invention.

If the use amount of the alkoxylated nitrogen-containing compound is less than 2 wt %, the transparency of the content may be decreased, and it is greater than 30 wt %, the strength of the cleaning agent may be lowered, and thus, collapse may occur during coating.

In the transparent solid cleaning agent, if a subsidiary transparency agent compound is mixed with the raw material composition, the transparency of the content may be increased.

Examples of the subsidiary transparency agent compound that may be added may include saccharides such as sugar, sorbitol, starch syrup, and the like, glycols such as ethyleneglycol, propyleneglycol, glycerin, and the like, and polyalcohols such as polyhydric alcohol, and the like.

The mixing ratio of the subsidiary transparency agent may be preferably 2 to 30 wt %, more preferably 5 to 20 wt % in the total raw material composition when manufacturing the transparent solid cleaning agent according to the present invention.

In addition, the transparent solid cleaning agent according to the present invention includes orange oil which performs a function for cleaning, and functions as a subsidiary cleaning agent of anionic surfactant. The orange oil may refer to one or more of the oils extracted from orange peel, orange flower, orange seed or orange leaf, and the like. Particularly, according to the embodiment of the invention, oil extracted from the orange peel may be preferable.

The orange oil may be preferably included in the amount of 0.1 to 10 wt % in the total raw material composition. If the amount is less than 0.1 wt %, cleaning performance may be lowered, and if it is greater than 10 wt %, transparency of the cleaning agent may be decreased.

Meanwhile, the transparent solid cleaning agent according to the present invention includes anionic surfactant. The anionic surfactant generally refers to a compound having relatively large molecular weight, which has an anionic group in the molecule, and forms a double salt with methyleneblue so that it may be dissolved in an organic solvent. And, the anionic part ionized in water may exhibit surface activity with strong cleaning performance. Thus, if the transparent solid cleaning agent according to the present invention is coated on a polluted part, the anionic part of the anionic surfactant may perform a function for cleaning, thus removing stain, and the like. And, even if stain is not immediately removed, since the anionic surfactant is maintained while being bound to the ingredients of the stain of the polluted part, stain may be easily removed when laundry washing after time passes.

The anionic surfactant may have average HLB(Hydrophile-Lipophile Balance) value of 7 or more. This is because cleaning performance may be lowered if the average HLB value is less than 7.

And, the anionic surfactant, although not specifically limited as long as it has average HLB value of 7 or more, may be selected from the group consisting of sodium lauryl sulfate, sodium lauryl ether sulfate, sodium lauryl ether sulfate, ammonium lauryl sulfate, ammonium lauryl ether sulfate, triethanolamine lauryl sulfate, triethanolamine lauryl ether sulfate, and magnesium lauryl ether sulfate.

Furthermore, sodium lauryl ether sulfate or triethanolamine lauryl ether sulfate may be more preferable because it has a little influence on the transparency and strength of the cleaning agent.

Meanwhile, the transparent solid cleaning agent may have a pen shape that is used while stored in a screw type holder. The transparent solid cleaning agent according to the present invention may be used in the form of a transparent solid cleaning agent (2) that is stored in a screw type holder (3), as shown in FIG. 1. Since the transparent solid cleaning agent has a pen shape, it is conveniently carried.

And, if stain is generated on clothes, and the like, it may be removed by coating the transparent solid cleaning agent, and immediately coating water, or using wet tissue, and the like.

And, in case it is difficult to remove stain instantly, the transparent solid cleaning agent may be only coated on the polluted part, so that it may be used for pre-removal of stain when clothes washing later.

Hereinafter, preferable examples of the present invention will be described. However, these examples are only to illustrate the invention, and the scope of the invention is not limited thereto.

A method for preparing the transparent solid cleaning agent according to the present invention, although not specifically limited, may include adding the gel forming material, transparency agent, subsidiary transparency agent, orange oil, and anionic surfactant in a container equipped with an agitator and a thermometer, and then, heat mixing and melting, pouring the molten material into a mold, and cooling. In this case, the order of adding each ingredient is not specifically limited.

More specifically, the ingredients are added at a specific ratio to a container equipped with an agitator and a thermometer, refluxed while agitating, heated to about 90° C., and mixed. The molten material is injected into a screw type holder, and cooled and solidified, or the cooled and solidified or extrusion-molded rod-shaped material is inserted into a cap-attached sealed container, thus preparing the transparent solid cleaning agent.

The transparent solid cleaning agent according to the present invention is used in the form of a transparent solid cleaning agent (2) that is stored in a screw type holder (3), as shown in FIG. 1. In FIG. 1, the reference number 4 indicates a handle for screw, and the reference number 1 indicates a cap for preventing drying.

Example 1

19.0 wt % of sodium stearate, 10.5 wt % of sodium laurate, 10.0 wt % of sodium myristate, 15.5 wt % of triethanolamine, 25.0 wt % of propyleneglycol, 5 wt % of orange oil, 15 wt % of sodium lauryl ether sulfate were put in an agitator and agitated at 90° C. for 1 hour, and then, the molten material was injected into a screw-type holder (3), cooled, and solidified to obtain a solid.

Example 2

19.0 wt % of sodium stearate, 10.5 wt % of sodium laurate, 10.0 wt % of sodium myristate, 15.5 wt % of triethanolamine, 25.0 wt % of propyleneglycol, 5 wt % of orange oil, 15 wt % of triethanol lauryl ether sulfate were put in an agitator and agitated at 90° C. for 1 hour, and then, the molten material was injected into a screw-type holder, cooled, and solidified to obtain a solid.

Comparative Example 1

A solid was prepared by the same method as Example 1, except using 19.0 wt % of sodium stearate, 10.5 wt % of sodium laurate, 10.0 wt % of sodium myristate, 28.5 wt % of triethanolamine, 27.0 wt % of propyleneglycol, and 5 wt % of orange oil.

Comparative Example 2

A solid was prepared by the same method as Example 1, except using 19.0 wt % of sodium stearate, 10.5 wt % of sodium laurate, 10.0 wt % of sodium myristate, 15.5 wt % of triethanolamine, 25.0 wt % of propyleneglycol, and 20 wt % of triethanol lauryl ether sulfate.

Comparative Example 3

A Solid was prepared by the same method as Example 1, except using 19.0 wt % of sodium stearate, 10.5 wt % of sodium laurate, 10.0 wt % of sodium myristate, 15.5 wt % of triethanolamine, 21.0 wt % of propyleneglycol, 15 wt % of orange oil, and 15 wt % of triethanol lauryl ether sulfate.

Comparative Example 4

A solid was prepared by the same method as Example 1, except using 19.0 wt % of sodium stearate, 10.5 wt % of sodium laurate, 10.0 wt % of sodium myristate, 25.5 wt % of triethanolamine, 29.8 wt % of propyleneglycol, 5 wt % of orange oil, and 0.2 wt % of triethanol lauryl ether sulfate.

Comparative Example 5

A solid was prepared by the same method as Example 1, except using 19.0 wt % of sodium stearate, 10.5 wt % of sodium laurate, 10.0 wt % of sodium myristate, 35.5 wt % of triethanolamine, 5.0 wt % of propyleneglycol, 5 wt % of orange oil, and 15 wt % of triethanol lauryl ether sulfate.

Experimental Example

The materials obtained in Examples and Comparative Examples (cylindrical shape with a length:50 mm, diameter: 11 mm) were withdrawn from the inside of a 50° C. thermostatic chamber, allowed to stand at room temperature for 2 hours, and then, the following evaluations were conducted.

(a) Cleaning Performance

Fibers polluted with soy sauce, red pepper paste, and coffee were fixed on the symmetry, and the materials obtained in Examples and Comparative Examples were repeatedly coated on the polluted parts three times while controlling pen pressure to 3N(306 gf)~4N(408 gf) as a mark of symmetry, and then, washed with running water for 1 minute, and then, observed with the naked eye.

⌈○⌋: There is no pollution that can be visually confirmed.

⌈x⌋: There remains pollution that can be visually observed.

(b) Transparency

The materials obtained in Examples and Comparative Examples were penetrated on the written lines on quality paper ⌈◎⌋: The written line can be very clearly confirmed.

⌈○⌋: The written line can be clearly confirmed.

⌈x⌋: The written line cannot be confirmed or can be obscurely confirmed.

(c) Strength

The compressive strengths of the materials obtained in Examples and Comparative Examples were measured using a strength meter (FB push-Pull Scale, IMADA JAPAN). It was measured each 5 times, and the average value was calculated.

The evaluation results are shown in the following Table 1.

TABLE 1

| Evaluation items | Example 1 | Example 2 | Comparative Example 1 | Comparative Example 2 | Comparative Example 3 | Comparative Example 4 | Comparative Example 5 |
|---|---|---|---|---|---|---|---|
| Cleaning performacne | ○ | ○ | X | X | ○ | X | ○ |
| Transparency | ◎ | ◎ | ○ | ○ | X | ◎ | ◎ |
| Strength (kgf/cm$^2$) | 9.75 | 9.85 | 9.60 | 9.70 | 9.57 | 9.79 | 6.76 |

As shown in the above Table, it can be seed that in the case of Comparative Examples wherein a part of the constructional ingredients according to the present invention are not added, or the constructional ingredients are added with different weight ratios, cleaning performance, transparency, or strength are inferior to Examples.

While this invention has been described in connection with what is presently considered to be practical exemplary embodiments of the transparent solid marker, it is to be understood that the invention is not limited to the disclosed embodiments, but, on the contrary, is intended to cover various modifications and equivalent arrangements included within the spirit and scope of the appended claims.

What is claimed is:

1. A transparent solid cleaning agent comprising 10 to 70 wt % of gel forming material including alkali metal salt or ammonium salt of C8-36 aliphatic carboxylic acid, 2 to 30 wt % of a transparency agent, 2 to 30 wt % of a subsidiary transparency agent, 0.1 to 10 wt % of orange oil, and 0.5 to 20 wt % of anionic surfactant, wherein the transparent solid cleaning agent has a pen shape that is used while stored in a screw-type holder.

2. The transparent solid cleaning agent according to claim 1, wherein the anionic surfactant has an average HLB value of 7 or more.

3. The transparent solid cleaning agent according to claim 1, wherein the anionic surfactant is selected from the group consisting of sodium lauryl sulfate, sodium lauryl ether sulfate, sodium lauryl ether sulfate, ammonium lauryl sulfate, ammonium lauryl ether sulfate, triethanolamine lauryl sulfate, triethanolamine lauryl ether sulfate, and magnesium lauryl ether sulfate.

4. The transparent solid cleaning agent according to claim 1, wherein the transparency agent is aliphatic amino alcohol.

5. The transparent solid cleaning agent according to claim 1, wherein the subsidiary transparency agent is selected from the group consisting of polysaccharides, glycols and polyalcohols.

6. The transparent solid cleaning agent according to claim 1, wherein the transparency solid cleaning agent is for stain removal of clothes.

7. The transparent solid cleaning agent according to claim 1, wherein the transparency solid cleaning agent is used for pre-removal of stain prior to clothes washing.

* * * * *